United States Patent [19]

Harvey

[11] Patent Number: 5,074,549

[45] Date of Patent: Dec. 24, 1991

[54] KNEE EXERCISE DEVICE

[76] Inventor: Clyde L. Harvey, 5702 Paseo Cimmarron, Tucson, Ariz. 85715

[21] Appl. No.: 566,128

[22] Filed: Aug. 13, 1990

[51] Int. Cl.[5] ..... A63B 23/04; A63B 23/00; A63B 3/00

[52] U.S. Cl. ..... 272/93; 272/96; 272/144; 128/25 R; 128/25 B; 128/84 R

[58] Field of Search ..... 272/93, 96, 144, 62, 272/63; 128/24 R, 25 R, 25 B, 84 R

[56] References Cited

U.S. PATENT DOCUMENTS

| | | | |
|---|---|---|---|
| D. 226,771 | 4/1973 | Jacobs | 272/63 |
| 2,638,089 | 5/1953 | Murphy | 128/25 B |
| 2,666,640 | 1/1952 | Jennings, Sr. | 272/93 |
| 3,189,347 | 6/1965 | Dodge . | |
| 3,379,434 | 4/1968 | Guzaldo | 272/144 |
| 3,540,724 | 11/1970 | Hunter . | |
| 3,787,048 | 1/1974 | Bock . | |
| 4,046,373 | 9/1977 | Kim | 272/144 |
| 4,314,697 | 2/1982 | Brumfield . | |
| 4,638,995 | 1/1987 | Wilson | 272/62 |
| 4,678,187 | 7/1987 | Prsala | 128/25 R |
| 4,838,545 | 6/1989 | Wilson | 272/117 |

FOREIGN PATENT DOCUMENTS

| | | | |
|---|---|---|---|
| 102400 | 3/1918 | Australia | 128/84 R |
| 2136605 | 2/1973 | Fed. Rep. of Germany | 272/62 |

OTHER PUBLICATIONS

New Foot and Leg Frames, Max Wacher & Son Co., Dec. 1931.

*Primary Examiner*—Richard J. Apley
*Assistant Examiner*—Karen G. Horowitz

[57] ABSTRACT

A knee exercise device for use by a patient adapted to receive the patient's lower thigh for placement upon a horizozntal cross piece to permit flexing of the lower leg up and down while the patient is lying horizontal with his or her upper portion of his or her leg up. The invention is comprised of two rectangular planar frames that are positioned on opposite sides of the patient's body with a horizontal cross piece attaching the long side of each rectangular frame at a point above the patient's body. It is over this cross piece that the patient places his or her leg. The patient grasps the vertical members of the rectangular frame to pull the frame, and thus the cross piece, towards his or her head in order to press the cross piece against the leg at the proper point when performing the knee exercises. In an alternate embodiment, an adjustable vertical member is added between existing vertical members for positioning along the upper and lower sides of the rectangular frame to be held by the user for the most comfortable and efficient use.

16 Claims, 1 Drawing Sheet

KNEE EXERCISE DEVICE

BACKGROUND OF THE INVENTION

1. Field of the Invention

The field of the invention is non-mechanized devices by which a person may therapeutically exercise his or her knee after the knee has been medically treated and exercises are called for by his or her physician or therapist.

2. Description of the Related Art

Individuals who have injured their knee to the extent that medical treatment is required, are directed by their physicians or therapists to exercise that knee in order to strengthen, straighten, or obtain more flexibility. In most cases, the physician or therapist will advise the patient to lie in bed or on the floor upon his or her back with the leg with the injured knee vertical, or as vertical as possible, and then to exercise the knee by flexing the lower portion of the leg from a leg-straight position to a position where the leg has been bent at the knee the maximum extent possible, i.e., to where the foot reaches a point as near the buttocks as is possible. In addition, the therapist may direct the patient to lie down and clasp his or her hands together under the lower portion of his or her thigh next to the knee and to pull the thigh forward while exercising the knee by raising and lowering the foot. These methods of exercise may obviously be enhanced by the use of an elevated horizontal cross bar upon which the exerciser may place the lower-under thigh of the leg. In addition, the therapist or physician may call for weights to be added to the lower leg wherein the knee is much strengthened by having to flex the leg with the added weight.

While the inventor is not aware of any specific non-mechanized knee exercise devices which facilitate the type of exercise contemplated by the instant invention, certain inventions have been patented which might possibly be used by an exerciser to accomplish some knee or leg exercises. For example, Hunter in U.S. Pat. No. 3,540,724 discloses a multi-positionable exercising device which has two horizontal bars adapted to rest upon the floor and two inverted "U" members which attach to the two horizontal bars to provide a pair of cross pieces elevated in the air. However, the second cross piece would be a hindrance to attempting the knee exercises anticipated, and if the second cross piece were removed, there would be very little inherent stability left in the device when attempting to use it.

Another device known to the inventor includes the physical exercising device of Brumfield, U.S. Pat. No. 4,314,697 wherein is disclosed an elevated horizontal exercising bar but which, in its attachment to the base, would prohibit the patient from lying on the floor or bed as required to do the exercise.

A third exercising device is shown in a United States Patent to Dodge entitled Gymnastic Apparatus, U.S. Pat. No. 3,189,347, wherein an elevated horizontal cross bar is supported by triangular shaped structural means resting upon a floor, however, the support mechanism for the horizontal bar would greatly interfere with the use of the bar by the patient for knee exercises.

Lastly, an exercise device detailed by Bock in U.S. Pat. No. 3,787,048 discloses a device which also supports a horizontal bar however, like Brumfield and Dodge, the remainder of the apparatus supporting the horizontal bar renders impossible the user's particular method of exercising.

It is therefore readily obvious that there is need for apparatus by which an exerciser may be provided a cross bar upon which to rest the lower portion of his or her thigh while exercising his or her leg which permits the free and unencumbered movement of the lower portion of the leg and which does not present obstacles to the remainder of the exerciser's body when using.

SUMMARY OF THE INVENTION

The embodiment of the invention described consists of a non-mechanized device with a leg support bar designed specifically to support the leg of a patient who needs to either strengthen or improve the flexibility of his or her knee or knees by exercising. When using the invention envisioned, the patient lies down on a flat horizontal surface such as a bed or a floor and exercises properly and comfortably.

The position of the patient's leg on the leg support bar depends upon the needs of the patient.

If the patient needs to strengthen his or her knee, the support bar should be under the knee.

If the patient needs to increase the flexibility of his or her knee, the support bar should be under the patient's thigh in close proximity to his or her knee. In order to keep the support bar in this position while exercising (not under the knee which is the normal tendency), it is necessary that the patient continually pull the horizontal support bar against his or her thigh so as to keep the bar away from a position immediately underneath the knee. The support provided can be easily imagined if a party were to stand up and place his or her leg over a horizontal bar where the lower extremity of the thigh rested on the bar and the lower leg hangs down vertically.

Briefly, the invention consists of two (2) rectangular spaced apart and parallel planar frames having a permanently attahced cross piece attaching at one of the long sides of each rectangular frame.

The rectangular frames are preferably constructed from PVC (Polyvinyl Chloride) pipe utilizing 90 degree PVC corners to form each frame. A cross piece which serves as the bar upon which the patient's leg is supported is attached to one of the long sides of each frame. (A PVC "T" coupling is preferably utilized with the cross piece attached to the central opening of the "T".) The patient grasps one of the vertical short sides of the rectangle when using the invention.

In an alternate embodiment, an additional enlarged "T" coupling is used on each of the long sides of each rectangular frame. These "T" couplings are capable of sliding up and down the long sides of each rectangular frame and are connected at the center "T" opening. Drilled through each long side of the rectangular frame having a sliding "T" coupling is a plurality of spaced apart holes. Likewise, drilled transversely through one of the in-line openings of the "T" coupler is a same sized hole. Furnished are pins sized to fit these holes. By means of the oversized "T" couplings and their connectors, and the pins which pass through the holes in the "T" couplings and the long side of the rectangular frames, the "T" couplings may be secured at various selected positions along the rectangular frames. Thus the "T" connector provides a positionally adjustable handhold along the frame.

The subject knee exercise device is utilized by firstly having the patient lie on his or her back on the bed or on the floor and then raise his or her leg whose knee is to be exercised. The invention is then pulled up along his or her body until the horizontal cross piece engages the under part of the person's leg. Each rectangular frame sets upright on opposite sides of the patient's body and the patient's body does not rest upon any part of the invention. The patient needs to grasp each rectangular frame by its upright member closest to the patient's hands. The patient pulls the invention towards themselves and, with his or her leg raised, places the cross piece of the device in its proper position according to the patient's needs.

As previously stated, the position of the patient's leg on the support bar depends upon the needs of the patient. If the patient needs to strengthen his or her knee, the support bar should be under the knee. If the patient needs to increase the flexibility of his or her knee, the support bar should be under the patient's thigh in close proximity to his or her knee. In order to keep the support bar in this position while exercising (not under the knee which is the normal tendency), it is necessary that the patient continually pull the horizontal support bar against his or her thigh so as to keep the bar away from a position immediately underneath the knee. Thus, the lower thigh portion of a person's leg is stabilized while knee exercises are accomplished.

Exercises are accomplished by flexing the lower leg over the range from a straight out position (relative to his or her upper leg) to a bending position as requested by the physician.

In addition, if desired, lead weights placed in saddle bags may be hung over the foot of the leg being exercised to add additional work to the exercise.

Additionally, a cloth covering may be wrapped around the horizontal cross piece such as to place a soft surface against the patient's lower thigh when exercising.

Accordingly, it is an object of the subject invention to provide:

1. A knee exercise device which can be operated by the patient themself to provide the necessary upper leg stabilization for the knee exercises.

2. A horizontal cross piece over which a patient may exercise his or her knee while the patient is lying comfortably on a horizontal surface such as a bed or floor.

3. A knee exercise device wherein the pressure of the horizontal cross piece urged against the patient's lower thigh may be varied by the patient themself while exercising.

4. A knee exercise device which provides the necessary horizontal cross piece to receive the patient's lower thigh and which may be operated by the patient lying in a horizontal position where no obstructions are presented over which the patient's body must lie.

5. A knee exercise device that exercises the knee in a position above the heart, thus helping in the prevention of swelling in the knee joint.

Other objects of the invention will in part be obvious and will in part appear hereinafter. The invention accordingly comprises the apparatus possessing the construction, combination of elements, and arrangement of parts which are exemplified in the following detailed disclosure and the scope of the invention which will be indicated in the claims.

BRIEF DESCRIPTION OF THE DRAWINGS

For further understanding of the features and objects of the subject invention, reference should be had to the following detailed description taken in connection with the accompanying drawings wherein.

In various views like index numbers refer to like elements.

DETAILED DESCRIPTION OF THE PREFERRED EMBODIMENT

Figure 1:
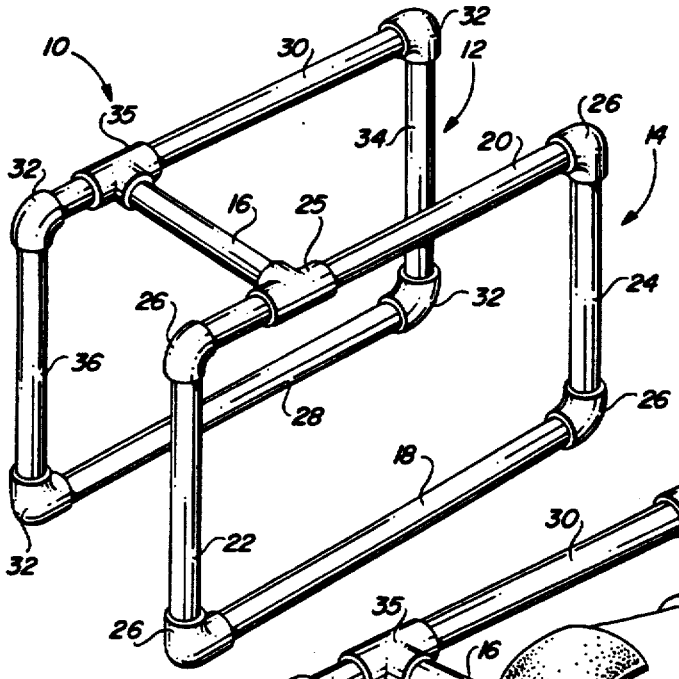
FIG. 1 is a perspective view of the subject invention.

The embodiment of the invention is shown in a perspective view in FIG. 1 comprising two rectangular parallel planar frames having a permanently fixed cross piece. This cross piece supports the leg of the user or exerciser by providing support.

More specifically, knee exercise device 10 is characterized by two parallel frames, namely left rectangular frame 12 and right rectangular frame 14, and horizontal cross piece 16 which joins the two frames and serves to separate the frames while holding them upright and in a rigid orientation. Right rectangular frame 14 is characterized by four structural members, namely lower and upper horizontal members 18 and 20 respectively, and front and rear vertical members 22 and 24. All members of right rectangular frame 14 are secured together in the rectangular shape by right angle couplers 26 which, in the preferred embodiment are all identical. In the preferred embodiment, those structural elements making up the right rectangular frame 14 consisted of PVC (polyvinyl chloride) pipe having a diameter of 1¼ inches. The right angle couplings 26 were 1¼ inch PVC right angle pipe couplings. The frame is assembled in the standard method, that is, of using the adhesive normally used.

Left rectangular frame 12 is similarly constructed, namely front and rear vertical members 36 and 34 respectively and lower and upper horizontal members 28 and 30 respectively are brought together with right angle couplings 32. The length as well as the diameter of the horizontal and vertical members of left rectangular frame are the same as the similar members in right rectangular frame 14. In the preferred embodiment of the invention, prior to assembly the horizontal members had a length of 18 inches and the vertical members had a length of 11 inches. Because of the size of the right angle pipe couplings, the rectangular frames had a resultant outside length and width a few inches greater than the lengths of its individual horizontal and vertical members.

As mentioned above, horizontal cross piece 16 connects the left and right rectangular frames together, cross piece 16 being similarly constructed of 1¼ inch PVC pipe. Making the actual connection between cross piece 16 and upper horizontal members 20 and 30 of the rectangular frames are "T" connections or couplers 25 and 35, "T" coupler 25 fixedly attached to upper horizontal member 20 and "T" coupler 35 fixedly attached to upper horizontal member 30. In actual construction, it was necessary that the upper horizontal members 20 and 30 be severed and slightly shortened to receive "T" coupler 25 (and the same for upper horizontal member 30) since the commonly available "T" couplers anticipate that two separate pieces of pipe join from opposite sides the in-line openings. Cross piece 16 is assembled in the centrally located opening of "T" couplers 25 and 35 in the commonly utilized manner of using PVC adhesive. Thus the top of the knee exercise device has become a rigid structure. The height, length, and width of the device will be varied to accommodate various sized users.

Once the knee exercise device 10 has been assembled, the left and right rectangular frames are rigid and parallel to each other through the fixed connection of the "T" couplers and horizontal cross piece. It has been found convenient for shipping and storage if the upper connection of vertical members 22 and 24 with the right angle couplings 26 to which they attach are not attached with an adhesive. Similarly, the same procedure is accomplished upon vertical members 34 and 36 with their respective right angle coupling 32. By this manner, the invention may be disassembled and assembled easily, and reduces considerably the volume required for shipping and storage.

Figure 3:
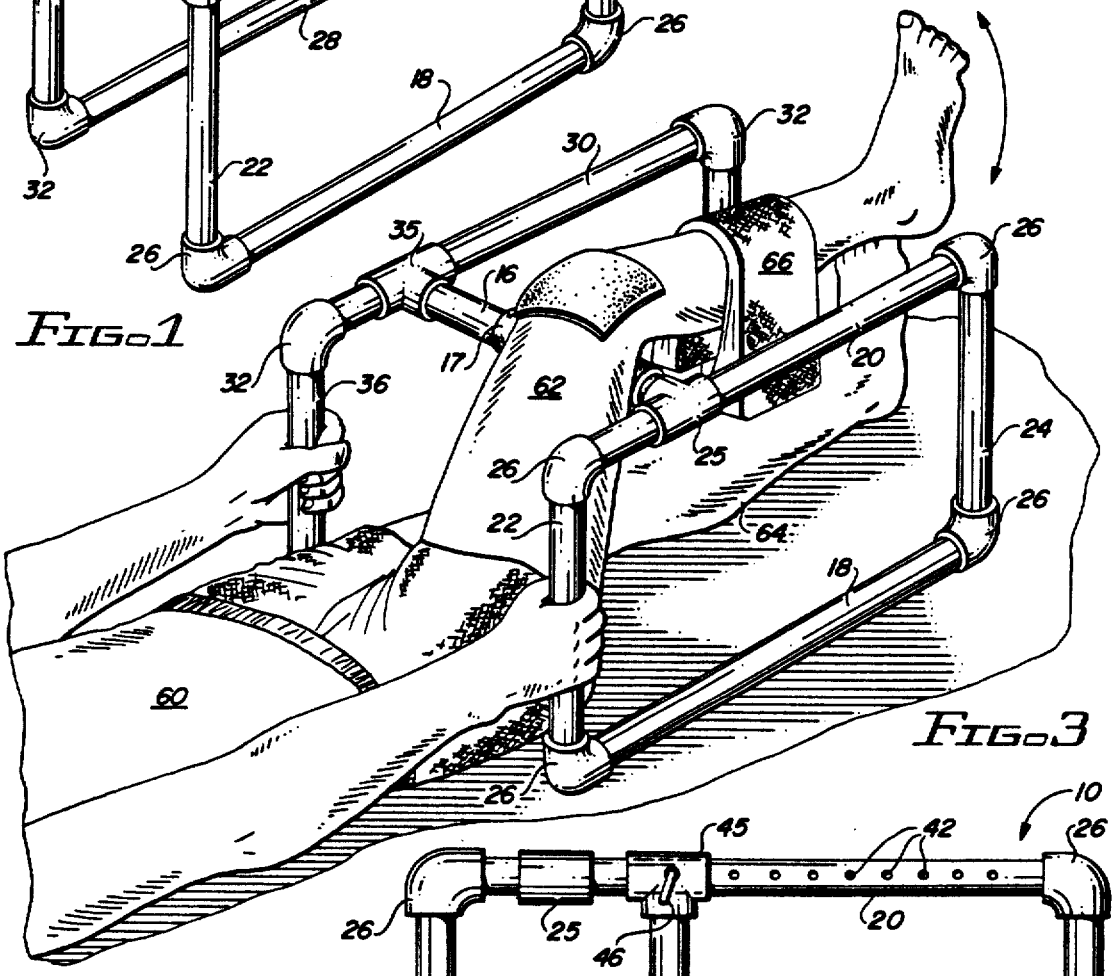
FIG. 3 is a perspective view of the subject invention in use by a patient.
Figure 2:
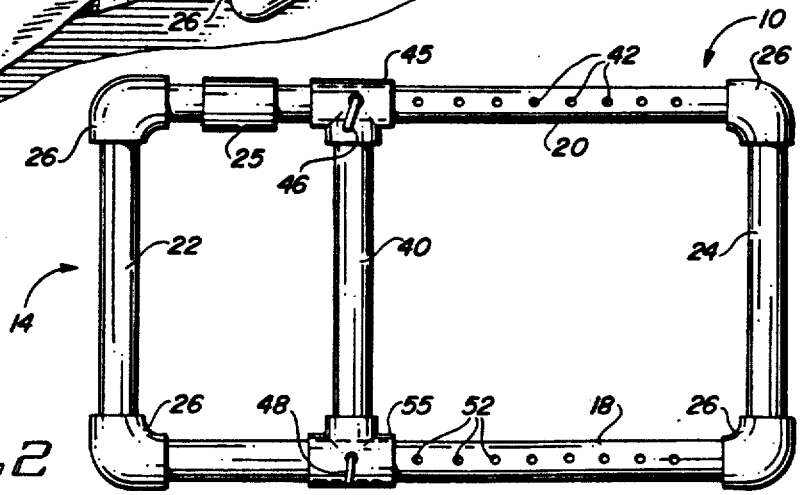
FIG. 2 is a side view of an alternate embodiment of the subject invention.

Since it is anticipated that different users may wish to position the invention at different places depending upon the angle of their leg relative to their torso, in order to provide hand grips at a comfortable position relative to the length of a user's arms (as illustrated in FIG. 3), an alternate embodiment of the device is shown in a side view in FIG. 2. Here, an additional vertical member has been made adjustable along the lengths of the upper and lower horizontal members. More specifically, and referring to FIG. 2, a side view of an alternate embodiment of the invention showing an adjustable vertical member is illustrated.

The same elements of the preferred embodiment of the device shown in FIG. 1 are utilized in the alternate embodiment as shown in FIG. 2 except for the additional vertical members and their associated "T" couplers. Thus, right angle couplers 26 still characterize the means to join the vertical and horizontal elements of the right rectangular frame. New adjustable vertical member 40 is shown connected at each end with "T" couplers 45 and 55. Drilled at spaced apart locations throughout the length of upper and lower horizontal members 20 and 18 are a plurality of holes 42 and 52 respectively. Then, in a sliding relationship upon upper and lower horizontal members 20 and 18 are the "T" pipe couplers 45 and 55 respectively, "T" couplers 45 and 55 not being adhered to horizontal members 20 and 18 but in fact being of a size such that the in-line openings are larger in diameter than the diameter of the PVC pipe utilized in upper and lower horizontal members 20 and 18 shown in FIG. 2. Fixedly attached then at the right angle portion (or central opening) of "T" couplers 45 and 55 is vertical member 40, the member held in a solid adhered configuration. Then, drilled transversely through the in-line openings of "T" couplers 45 and 55 is a hole through which passes links or pins 46 and 48, pin 46 and 48 passing both through the holes in "T" couplers 45 and 55 and through the holes 42 and 52 of the upper and lower horizontal members 20 and 18.

It is anticipated that all of the holes which are drilled in upper and lower horizontal members 20 and 18, together with the holes drilled through "T" couplers 45 and 55, should be only slightly larger than pins 46 and 48 to insure a snug fit.

By the alternate embodiment of the invention shown in FIG. 2, the position of vertical member 40 relative to the front ends of the right rectangular frame may be adjusted to where the user's hands and leg are in the most comfortable position. The same modification to left rectangular frame 12 is made as was accomplished on frame 14 shown in FIG. 2. With the construction described in connection with FIG. 2, it is obvious that the modifications to left rectangular frame 12 may be easily made.

Referring now to FIG. 3, a perspective view of the subject invention in use by a person is shown. User or exerciser 60 is reclining on a bed or the floor, grasping the invention in both hands, the left leg residing between the left and right rectangular frames while the right leg is being exercised. As can be seen, exerciser 60 is holding the front vertical members 22 and 36 respectively, one in each hand, while the user's right leg 62 is riding up and over cross piece 16. Please also note that a towel or other material wrap 17 surrounds cross piece 16 and is the actual part of the invention that the user's leg comes in contact with.

The user's leg 62 is bent at the knee with the lower leg hanging down slightly below the level of cross piece 16. Material wrap 17 is intended to be up against the lower portion of the thigh of the user's leg 62 during the time the lower leg is on the opposite side of cross piece 16. To urge material wrap 17 against the lower portion of the thigh, and not allow it to come directly under the person's knee, it is necessary to continually pull the invention toward the user's head and that is accomplished by the user's hold on the front vertical members 22 and 36.

Hanging on the lower foot are added weights 66 which comprises a saddle bags like device which is flexible and has pockets to hold weights. By this means, the person's knee may be exercised with the added weight to the leg. The user's left leg 64 is shown comfortably residing between the left and right rectangular frames, not being required to lay over any cross pieces between the left and right rectangular frames.

Thus with the invention as shown, pressure by cross piece 16 (through material wrap 17) is placed upon the under lower thigh area of leg 62 by the person pulling both rectangular frames toward themselves while at the same time lifting and lowering his or her lower leg 62 with or without added weights 66.

The operator then is in position to do the requisite knee exercise called for by the physician in repairing the damage to the knee.

While a preferred embodiment of the invention, together with an alternate embodiment, has been shown and described, it is appreciated that other embodiments of the invention are possible and that there is no intent to limit the invention by such disclosure, but rather it is intended to cover all modifications and alternate embodiments falling within the spirit and the scope of the invention as defined in the appended claims.

I claim:

1. A knee exercise device for use by a patient lying on his or her back on a flat surface, the exercise device overlaying the patient and having no part underneath the patient, the knee exercise device comprising:

a first rectangular frame having an upper and lower horizontal member, and a front vertical member handgrip and a rear vertical member;

a second rectangular frame having an upper and lower horizontal member, a front vertical member handgrip and a rear vertical member, said second rectangular frame spaced apart from said first rectangular frame; and a single means connecting said first and second rectangular frame comprising a fixedly attached horizontal support bar adapted to receive a leg of the patient, said single horizontal support bar operably attached to said upper horizontal member of said first rectangular frame and to said upper horizontal member of said second rectangular frame;

said front vertical member handgrip of said first rectangular frame and said second rectangular frame for grasping by the patient to position said exercise device relative to the patient whereby the patient may exercise one of his or her legs over said horizontal support bar to perform knee exercises on that leg.

2. The knee exercise device as defined in claim 1 wherein each said first and second rectangular frame lower and upper horizontal member has a length and two ends, and each said front and rear vertical member also has a length, said front and rear vertical member length less than said lower and upper horizontal member length.

3. The knee exercise device as defined in claim 2 wherein said horizontal support bar has two ends, one end of which is operably connected to said first frame upper horizontal member and said second end of said horizontal cross piece is operably connected to said second frame upper horizontal member.

4. The knee exercise device as defined in claim 3 wherein said horizontal support bar operably connected to said upper horizontal member of said first frame and said second frame is operably connected proximate one end of each said horizontal member.

5. The knee exercise device as defined in claim 4 wherein said first frame spaced apart from said second frame is spaced apart sufficient to permit the patient's body to lie between said first and second rectangular frame whereby the knee exercise device is situated on both sides of the patient with the horizontal support bar passing over the patient.

6. The knee exercise device as defined in claim 5 wherein said first frame is planar, said second frame is planar, and said first rectangular frame is parallel to said second rectangular frame.

7. The knee exercise device as defined in claim 6 wherein each said upper and lower horizontal member and each said front and back vertical member of said first and second rectangular frame comprise PVC pipe, and said horizontal support bar also comprises PVC pipe.

8. The knee exercise device as defined in claim 7 wherein each said front and rear vertical members are joined to each said upper and lower horizontal members of each said first and said second rectangular frame by right angle couplings, said right angle couplings also comprising PVC pipe couplings.

9. The knee exercise device as defined in claim 8 wherein said horizontal support bar operably connected to said first frame upper horizontal member and said second frame upper horizontal member is connected utilizing "T" PVC couplers.

10. The knee exercise device as defined in claim 6 further including:

a first middle vertical member handgrip operably attached to said first rectangular frame upper and lower horizontal member;

a second middle vertical member handgrip operably attached to said second rectangular frame upper and lower horizontal member;

each said first and second vertical member handgrip having an upper and lower end and a pair of "T" couplings, each of said pair of "T" couplings attached at said first and second vertical member handgrip upper and lower end; and said first and second middle vertical member "T" couplings slideably situated upon each said upper and lower horizontal member of each said first frame and said second frame, said first and second middle vertical member handgrip grasped by the patient to position said exercise device relative to the patient.

11. The knee exercise device as defined in claim 10 wherein each said first and second frame upper and lower horizontal member includes a plurality of spaced apart openings passing through said member.

12. The knee exercise device as defined in claim 11 wherein said "T" couplings attached to each said vertical middle member includes an opening therethrough adapted to align with said plurality of openings through each said upper and lower horizontal member.

13. The knee exercise device as defined in claim 12 further including an upper and lower pin for each said first and second rectangular frame, said upper and lower pin adapted to penetrate the opening of each said upper and lower "T" couplings and through each said upper and lower horizontal member of each said first and second frame.

* * * * *